United States Patent [19]

Macrow

[11] Patent Number: 4,861,355

[45] Date of Patent: Aug. 29, 1989

[54] IONIZER DIFFUSER AIR PURIFIER

[76] Inventor: Lawrence Macrow, 1142 Cypress Point Dr. S., Venice, Fla. 33595

[21] Appl. No.: 34,638

[22] Filed: Apr. 6, 1987

[51] Int. Cl.[4] ..... B03C 3/12

[52] U.S. Cl. ..... 55/127; 55/131; 55/138; 55/152

[58] Field of Search ..... 55/2, 127–131, 55/138, 149, 152, 154, 471, 477; 361/226, 230

[56] References Cited

U.S. PATENT DOCUMENTS

| | | | |
|---|---|---|---|
| 832,767 | 10/1906 | Bridge | 55/129 |
| 1,342,651 | 6/1920 | Squires | 55/138 X |
| 1,931,436 | 10/1933 | Deutsch | 55/131 |
| 2,240,495 | 5/1941 | Dillon et al. | 55/152 X |
| 2,700,429 | 1/1955 | Wintermute | 55/152 X |
| 2,871,974 | 2/1959 | Werst | 55/137 X |
| 3,538,657 | 11/1970 | Macrow | 55/477 X |
| 3,716,966 | 2/1973 | De Seversky | 55/138 X |
| 3,958,962 | 5/1976 | Hayashi | 55/154 X |
| 4,018,578 | 4/1977 | Ahlrich | 55/138 |
| 4,093,432 | 6/1978 | Ahlrich | 55/138 |
| 4,344,776 | 8/1982 | Yavnieli | 55/129 |
| 4,473,382 | 9/1984 | Cheslock | 55/131 X |
| 4,533,368 | 8/1985 | Snaddon et al. | 55/129 X |

FOREIGN PATENT DOCUMENTS

| | | | |
|---|---|---|---|
| 344705 | 11/1921 | Fed. Rep. of Germany | 55/150 |
| 1034841 | 8/1953 | France | 55/154 |

*Primary Examiner*—Charles Hart

*Attorney, Agent, or Firm*—Gifford, Groh, Sheridan, Sprinkle and Dolgorukov

[57] ABSTRACT

An ion diffuser has a frusto-conical surface made of thin metal in which surface are a plurality of emitter orifices. Around the perimeter of each orifice are a plurality of raised points that are angled toward a stream of dirty gases flowing through each emitter port. Submicron particles are ionized as they pass through the orifices when the metal is energized positively from a high voltage powerpack. A fan, to which are connected filaments, rotates above the frusto-conical surface and the submicron particles are collected by the filaments.

15 Claims, 2 Drawing Sheets

IONIZER DIFFUSER AIR PURIFIER

BACKGROUND OF THE INVENTION

1. Field:

The present invention relates to air purifiers and, more particularly, to purifiers of the centrifugal filtration type incorporating an ionization feature and the method for removing particulates from contaminated air.

2. Prior Art:

Prior art apparatus is represented by the structure of U.S. Pat. No. 3,538,657 to L. Macrow that describes a gas-liquid contact apparatus wherein there are two separate gas-liquid stages. U.S. Pat. No. 3,544,084 to L. Macrow also describes an improved gas-liquid contact apparatus for effective mixing between a gas and a liquid without appreciable entraining the liquid in the gas, and without experiencing a substantial pressure drop in the gas passing through the apparatus.

Prior art apparatus that purifies contaminated air or gas streams direct the air through a rapidly rotating filtration element made of nylon threads. Fine particles of oil mist encountering the revolving nylon threads are trapped in the capillary structure of the threads and, under the influence of centrifugal force, flow to the outer periphery of the element and are thrown off into the housing around the element.

It was found that this system operated with high collection efficiency for droplets of relatively large size, that is, in excess of 2 or 3 microns diameter. But particles of much smaller size, that is, down to submicron size, were of such small mass that they could not be impacted on the rotating threads, and passed through the rotating element along with the air stream. Thus, the prior art apparatus was capable of achieving 98% to 99% collection efficiency by weight, if the particulates being collected were principally of large size, that is, in excess of 2 or 3 microns. However, if the major portion of the particulates were in the range of less than 2 or 3 microns and down into the submicron range, a much larger percentage by weight would pass through the element, thus materially reducing its collection efficiency by weight, on predominantly small particulate.

To improve overall efficiency under these conditions, a two-stage unit was made available, which added a bank of electrostatic filters on the discharge of the centrifugal filtration element. The second stage than collected the small particulate which had passed through the first stage, at a relatively high efficiency, which is typical of the electrostatic filter on small particulate. Thus, the two-stage unit produced a high combined efficiency due to the high basic efficiency of the centrifugal filtration element on large particulate, and the high basic efficiency of the electrostatic unit on small particulate.

However, the two-stage unit was bulky and costly.

The present invention for ionization of small particulate overcomes the weaknesses of previous wire-type ionizers. In general, these consist of fine wires carrying the ionizing voltage, which are stretched across the incoming dirty air stream. Streams of ions emit from the fine ionizer wire across the air stream. However, the fine ionizer wire tends to coat itself with impurities from the air stream, forming an uneven coating on the wire and, at points where this occurs, it prevents the emission of ions. Thus, after prolonged operation of the system, ionization is no longer uniform along the length of the ionizer wire and the ionizing field is broken up into stratified layers. Thus, some particles pass through the ionizer without becoming ionized and consequently are not collected and the efficiency of collection drops. It is then necessary to totally clean the ionizer wire by removing the coating with abrasives or chemicals to restore a totally clean surface which will then generate uniform ion flow. While the problem of keeping ionizers clean vaires with the severity of the application, it is nevertheless a difficult and time consuming operation, which, if not timely performed, results in deterioration of the equipment as well as performance. This comes about because, when ionizer wires become coated, preventing normal ionization, voltage in the circuit rises to an abnormally high level causing arcing at other points in the collector cell or powerpack components.

SUMMARY OF THE INVENTION

An object of the present invention is to increase the efficiency of the centrifugal filtration element on small particulate matter, making it unnecessary to utilize the two-stage arrangement on many installations;

A further object of the present invention is to improve previous single stage units by the addition of an accessory package; and A still further object of the present invention is to produce an ionizing system that will be: (1) more efficient in generating an ionizing field; (2) inexpensive to manufacture when compared to the cost of prior art ionizing systems; and (3) extremely easy to clean and maintain.

To accomplish these objectives, the present invention employs point emissions, instead of wires, in the ion diffuser for ion generation in conjunction with orifices of special shape for air flow control.

Other objects and advantages of the present invention will become apparent to those skilled in the art when the following description of the best modes contemplated at the present time for practicing the invention are read in conjunction with the accompanying drawing, wherein like reference numerals refer to like or equivalent parts.

DETAILED DESCRIPTION

Figure 1:
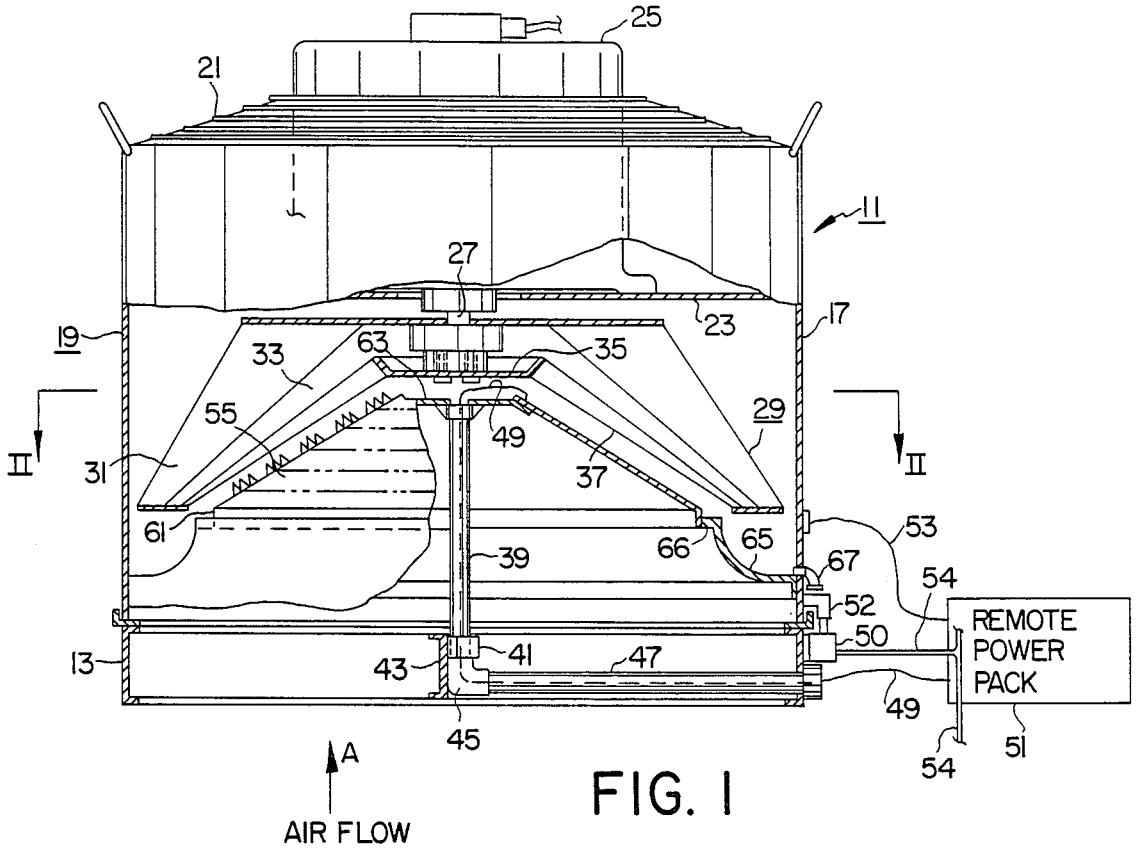
FIG. 1 is a schematic elevational view, partially in section, of an ionizer diffuser in accordance with the present invention.
Figure 2:
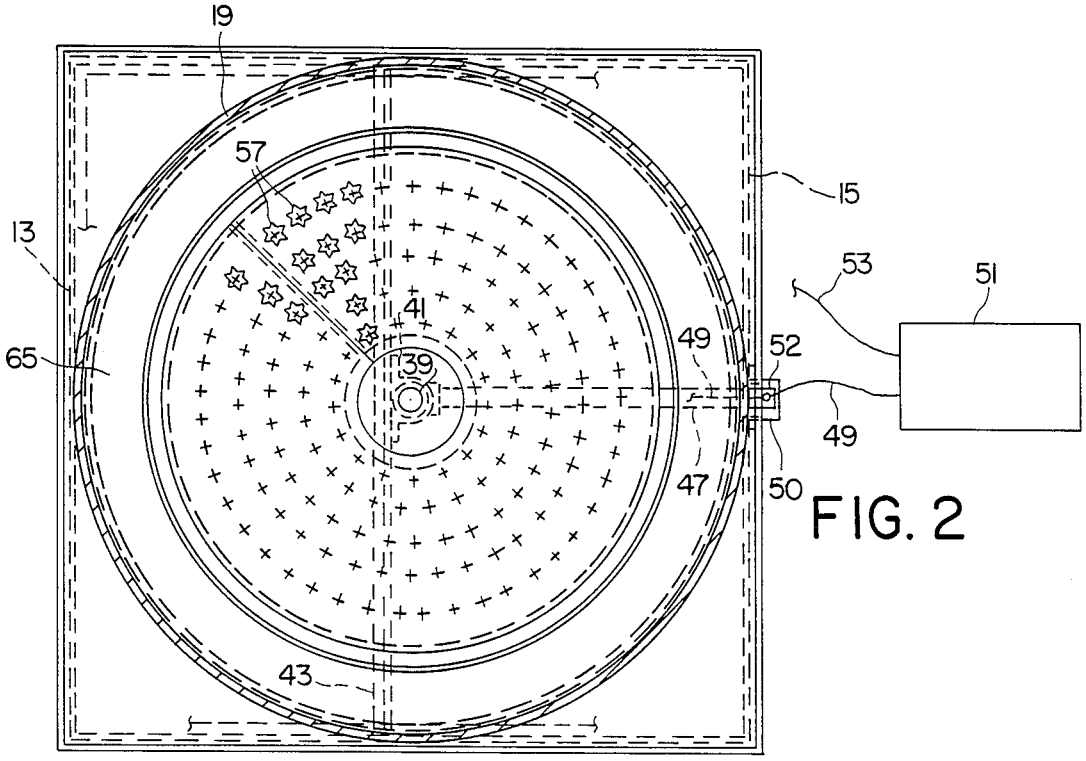
FIG. 2 is a view along line II—II of FIG. 1.

Referring to FIG. 1, a collector 11 equipped with an ionizer diffuser 55 of the present invention includes a rectangular inlet plenum 13 having a structural base comprising channel-shaped sides 15 on which is supported vertical sides 17 of a cylindrical chamber 19 on top of which is a frusto-conical grill structure 21 for distributing air.

Within the chamber 19 is a transverse plate 23 that supports an electric motor 25, the shaft 27 of which extends below the transverse plate 23 and to which is fixed a fan 29 comprising a plurality of fan blades 31.

Each fan blade 31 has a trapezoidal shape, and the entire configuration of the fan 29 has a frusto-conical shape with a frusto-conical cavity 33 axially located in the fan 29.

The lower end of the motor shaft 27 terminates in a removable transversely extending flat plate 35, and from the outer perimeter of the removable plate 35, to the lower ends of each fan blade 31 extend filament threads 37, preferably nylon threads.

Centrally located in the chamber 19 and extending upward from within the plenum 13 is a tubular conduit 39 that is supported in the plenum 13 by means of a clamp 41 encompassing the tubular member 39 and secured to a transverse structural channel 43. The tubular member 39 is connected to an elbow 45 that connects to a tubular conduit 47 carrying an electrical wire 49. The wire 49 is connected to the positive terminal of a high voltage powerpack 51. The wire 49 emerges from the top of the tubular member 39 and connects to the ion diffuser 55. The negative terminal of the powerpack 51 is connected by a wire 53 to the side 17 of the chamber 19.

A safety interlock switch 50, normally open, is mounted to the side 15 and is actuated by a fixed projection 52 on the side 17. The normally open switch 50 is connected to wires 54 bringing 110-volt current to the powerpack 51. The normally open interlock switch 50 opens when the cylindrical chamber 19 is removed; otherwise it is closed when the cylindrical chamber 19 is in position for normal operational use.

Figure 3:
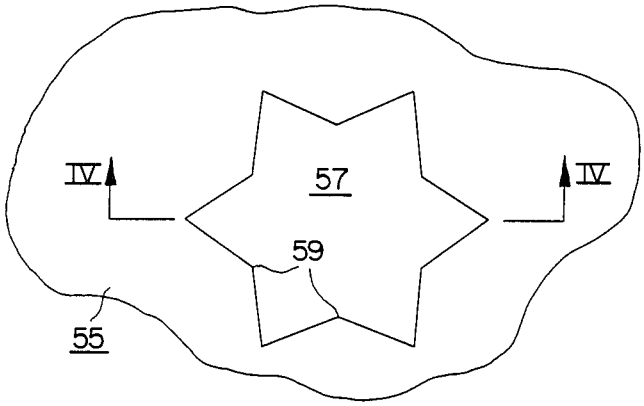
FIG. 3 is a plan view of a typical orifice in the ionizer diffuser of FIG. 1.

The ion diffuser 55 is a frusto-conical surface in which are a plurality of perforations or orifices 57 having the shape shown in FIG. 3 and as shown along line IV—IV of FIG. 3.

Figure 4:
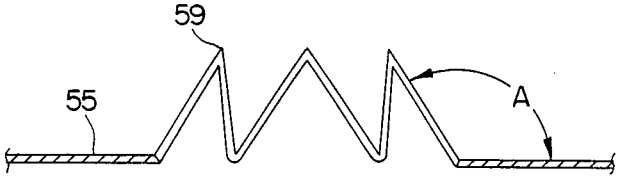
FIG. 4 is a view along line IV—IV of FIG. 13.
Figure 5:
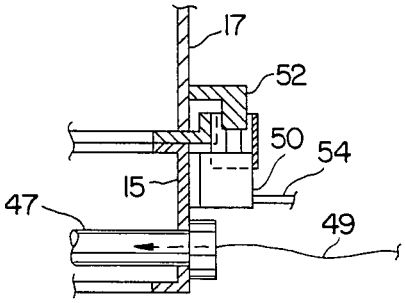
FIG. 5 is a view of a portion of FIG. 1 showing a detail thereof.

As shown in FIG. 3, each perforation or orifice 57, in plan view, has a star-like appearance and, as shown in FIG. 4, each orifice 57 has a plurality of emission points 59. The emission points 59 are formed by stamping holes or orifices in the sheet metal, preferably aluminum, formed as a frusto-conical surface 55, raising the points 59 so formed that the angle "A" between a point 59 and the frusto-conical metal surface is greater than 90°. But, it is understood that the optimum angle has to be determined by experimentation.

Formulation of the emission points 59 in this manner provides an orifice 57 through which the air flows. Because of the shape of the orifices 57, air is forced into a series of air streams, each flowing around an emission point 59. The stream of ions flowing from a point 59 expands at an angle of around fifteen degrees and, since the air stream emerging from the orifice 57 is expanding at approximately the same angle, and both the ions and the air stream are moving in the same direction, the ion stream expands naturally into the air stream, making it unlikely that any solid or liquid particles can escape becoming ionized.

The shape of the ion generator 55 shown in FIG. 1 need not be confined to a frusto-conical arrangement. Its configuration may be matched to any design of collection surface,—flat or otherwise.

Likewise, orifices 57 in the frusto-conical plate 55 need not be star-shaped, as shown. They can be any shape; the only requirement being that a series of points 59 is created around each orifice 57 for contact with the streams of ions in the gas flow jet, and that the points of emission are directed toward the center of the gas flow jet.

The orifices 57 are arranged in concentric circles, but the orifices 57 are not aligned along surface generator elements of the frusto-conical diffuser 55. Rather, the several orifices are spaced apart equally along each concentric circle.

The frusto-conical diffuser 55 has a depending skirt 61 around its lower perimeter. The frusto-conical diffuser is mounted to an annular plate 63 closing the top of the frusto-conical diffuser 55, and to the top end of the central tubular conduit 39. The wire 49 protrudes out of the conduit 39 and is connected to the surface of the frusto-conical diffuser.

Surrounding the skirt 61, in spaced-apart relation, is an arcuately formed drain sump 65, shaped about as shown in FIG. 1, and there is a drain pipe and elbow combination 67 at the side 17 of the unit 11 for removing fluid or particulate from the sump 65. Insulating gasket 66 maintains separation of the skirt 61 from the grounded sump 65, and prevents contaminated air from bypassing the orifices 57.

In operation, contaminated air or a gas stream flowing in the direction of the arrow "A", enters the unit 11 at the bottom and flows upward into the frusto-conical cavity formed by the frusto-conical shell 55. When the contaminated air or gas stream emerges from the perforations or orifices, there being six such points around each orifice in a preferred embodiment of the present invention, an ionizing field at each point of the orifices develops by applying a suitable voltage to the diffuser surface. The voltage ordinarily applied in electrostatic filtration is in the range of 6 to 12 kilovolts. Ions flow from the points around the orifices toward the filtration element at opposite polarity. Because of the location of the ionizing points in the jets of air or gas stream passing through the multiplicity of orifices in the diffuser plate, an intimate mixing of ions with the particulate matter of pollutants is readily accomplished.

The extremely small particles are charged and are easily collected in the element structure of opposite polarity. Large particles also pass through the ionizing field, but need not be charged because they will be collected easily by impaction on the centrifugal filtration element comprising the fan and the fibers that are rotated by the motor.

Because the ionizing diffuser needs to be effective only on the extremely small particulate matter, it can be relatively small and compact compared to conventional electrostatic filters.

A feature of the invention is the upper structure 17 may be removed easily to facilitate cleaning and servicing of the ionizer assembly.

Another feature of the invention is the safety interlock switch 50, which is normally open. It closes only when the cylindrical chamber 19 is in place for normal operational use. When the upper structure is removed, the interlock switch interrupts the power supply to the powerpack 51.

Although the invention has been described herein with a certain degree of particularity, it is understood that other modifications may be made therein without departing from the scope of the present invention as defined by the following claims.

What is claimed is:

1. An ionizing diffuser being frusto-conical in shape and having a plurality of orifices through which contaminated gas passes, each of said orifices having a plurality of points around its perimeter and being so arranged that a gas stream passing through each orifice forms jets and each jet passes around a stream of ionized particles generated from said points within said gas stream.

2. The diffuser of claim 1 wherein said diffuser has a vertical axis and said orifices are spaced apart uniformly on concentric circles perpendicular to said vertical axis.

3. The ionizing diffuser of claim 1 wherein said diffuser includes a bottom and a skirt encompassing the perimeter of said bottom.

4. An ionizing diffuser being frusto-conical in shape and having a plurality of orifices through which contaminated gas passes, each of said orifices having a plurality of points around its perimeter and being so arranged that a gas stream passing through each orifice forms jets and each jet passes around a stream of ionized particles generated from said points within said gas stream, said diffuser being mounted to a tubular conduit and being connected to a positive terminal of a power supply.

5. A housing within which is fixedly mounted a diffusing ionizer having a frusto-conical surface; a plurality of orifices in said surface; a fan rotatably mounted within said housing having a plurality of fan blades shaped to conform in spaced-apart relation to the frusto-conical surface of said diffusing ionizer; a plurality of filaments supported by said fan blades; a motor mounted to said housing and connected to said fan for rotating said fan; means for admitting air into said housing so that said air flows through said frusto-conical diffusing ionizer and out of said orifices; means for electrically charging the surface of said frusto-conical diffusing ionizer; and means for distributing air flow emerging from said housing.

6. The structure of claim 5 wherein said orifices have a plurality of triangular ionizer points around the perimeter of each orifice and extending upwardly from said frusto-conical surface.

7. The structure of claim 6 wherein said triangular ionizer points slope upwardly at an angle greater than 90° from the surface of said frusto-conical diffusing ionizer toward said air flow through said orifices.

8. The structure of claim 5 wherein the perimeter of said frusto-conical diffuser has a cylindrical bottom portion, and including means for collecting liquid removed from air entering said ionizer diffuser.

9. The structure of claim 8 including sealing means disposed between said collecting means and said cylindrical bottom portion.

10. The structure of claim 5 wherein said orifices are randomly arranged on said frusto-conical surface.

11. The structure of claim 5 wherein said filaments are threads.

12. The structure of claim 5 wherein said means for distributing air from said housing is a grill.

13. In an ion diffuser having a frusto-conical shape the improvement comprising a plurality of emitters through which gas passes wherein each emitter comprises a plurality of upstanding points over which said gas passes.

14. The improvement of claim 13 wherein said points are electrically charged.

15. The method of forming an ion diffuser comprising the steps: forming a plurality of emitter ports in a flat sheet of metal and forming thereby a plurality of randomly spaced emitter orifices with a plurality of raised points around the perimeter of each orifice; forming said sheet of metal to make a frusto-conical surface; and forming a cylindrical lower edge thereon.

* * * * *